US006836909B1

(12) United States Patent
Kirsopp

(10) Patent No.: US 6,836,909 B1
(45) Date of Patent: Jan. 4, 2005

(54) SHOWER CURTAIN CLOSURE

(76) Inventor: Derek Kirsopp, 406 Camden Ct., Lanoka Harbor, NJ (US) 08734

( * ) Notice: Subject to any disclaimer, the term of this patent is extended or adjusted under 35 U.S.C. 154(b) by 0 days.

(21) Appl. No.: 10/861,866

(22) Filed: Jun. 7, 2004

(51) Int. Cl.[7] ..... A47K 3/22
(52) U.S. Cl. ..... 4/609
(58) Field of Search ..... 4/607, 608, 609, 4/610, 557, 558

(56) References Cited

U.S. PATENT DOCUMENTS 3,639,919 A * 2/1972 White ..... 4/558
4,759,087 A * 7/1988 Zeilinger ..... 4/605
6,148,452 A * 11/2000 Kirsopp ..... 4/609
6,321,397 B1 * 11/2001 Fogg et al. ..... 4/609

* cited by examiner

*Primary Examiner*—Gregory L. Huson
*Assistant Examiner*—Huyen Le
(74) *Attorney, Agent, or Firm*—Clifford G. Frayne

(57) ABSTRACT

A system is provided for converting a bathtub area into an enclosed substantially waterproof shower enclosure by means of adding or modifying the shower curtain installation by providing inner closure channels at each end of the shower curtain as well as corresponding outer retention channels that are easily fixed onto opposed walls in the bathtub enclosure for sealingly receiving the side edges of the curtain in a waterproof relationship. Each end of the shower curtain is retained within a vertically disposed U-shaped inner channel having longitudinal ridges within the U-shaped channel for retention of a flexible slit grommet spline or locking rod running lengthwise. The edge of the shower curtain is inserted into the flexible spline or locking rod which is then pressed fitted into the inner U-shaped channel. The curtain is securely retained by friction between the spline and the internal longitudinal ridges and walls of the U-shaped inner channel which is secured to the outer retention channel in similar fashion.

10 Claims, 5 Drawing Sheets

SHOWER CURTAIN CLOSURE

RELATED APPLICATIONS

Applicant is the holder of U.S. Pat. No. 6,148,425 based on application Ser. No. 09/307,480, issued Nov. 21, 2000, entitled "Closure for Shower Curtain".

BACKGROUND OF THE INVENTION

1. Field of the Invention

This invention relates to closures for showers and bathtubs and more specifically to a shower curtain closure assembly.

2. Description of the Prior Art

The device of the present invention is related to an improved closure device for shower curtains. The device may also be used in connection with tarps, curtains, and covers and other related fields where a closing device for a curtain-like structure is employed.

Utilization of shower curtains to try to prevent water from the shower from going outside the shower enclosure at the edges is well known. Shower curtains are often pulled away from the edge of the shower or tub enclosure by the vacuum created by the velocity of the water from the shower head according to well-known phenomena.

Often the typical shower curtain does not adequately prevent water from spilling onto the bathroom floor as the curtain moves away from the shower walls due to the decreased pressure of air entrained with the water spray. In addition, this effect can be due to an open window or door blowing the curtain. A further problem arises since household pets such as cats like to sleep in cool places such as the shower.

Attempts have been made to keep shower curtains in place by wetting the edge of the shower enclosure wall and sticking the curtain to it. Other devices include magnets or suction cups at the bottom of the shower curtain to keep the curtain against the inside of the bathtub walls. These techniques do not prevent the water escaping through the sides onto the floor. Also when it is necessary to remove the curtain for cleaning or washing, the magnets or suction cups would often break in the washing machine, making the arrangement useless.

It is the purpose of the present invention to provide a shower closure device for a curtain which is aesthetically appealing with the curtain attached and which causes water to remain inside of the tub instead of spilling onto the floor. The curtain will not be blown aside drafts from open windows. The device is easily installed and removed for cleaning of the curtain. It gives the appearance of a sealed door enclosure without the high cost of installing a conventional glass shower tub enclosure. In addition it serves to keep pets out of the tub.

The closest prior art references of which the Applicant is aware of are Applicant's prior U.S. Pat. No. 6,148,425 and the following:

U.S. Pat. No. 2,761,140 to Kellogg discloses a shower curtain unit for use with built-in bathtubs. Notable in this patent is the utilization of a vertical tube 45 secured at each end by the internal rods 47 and 48, and retained in brackets at the top and bottom of the tube enclosure. The shower curtain 19 is hemmed at the end, with an opening provided in the hem through which the tube 45 is fitted.

U.S. Pat. No. 4,887,324 to Cairns discloses a curtain retainer apparatus which is noted for its method of retaining the curtain 138 and flexible retainer means having beaded interlocking heads as shown in the drawings. This is particularly useful for shower curtains.

In U.S. Pat. No. 3,205,547 to Riekse a combination of flexible retainer and locking strip 24 is shown in cross section in FIGS. 3 and 4.

U.S. Pat. No. 3,639,919 to White (See FIGS. 2 and 3), wherein the end of a curtain is retained within the holder having a resilient core 20 fitted into a hem of the curtain 19.

The disclosure in U.S. Pat. No. 2,897,889 to Kessler illustrates a common way of retaining screening utilizing a ribbed resilient cord.

Other patents of general interest in this area are U.S. Pat. No. 2,712,354 to Margolies; U.S. Pat. No. 3,187,801 to Saling; U.S. Pat. No. 3,366,161 to Barnett; U.S. Pat. No. 3,855,642 to Blitch; U.S. Pat. No. 4,361,915 to Siewert; U.S. Pat. No. 4,595,741 to Payne; U.S. Pat. No. 5,148,580 to Dyckow; and U.S. Pat. No. 5,339,884 to Angerman.

The present invention is a significant improvement over the devices shown in the prior art patents individually and collectively.

OBJECTS OF THE INVENTION

Accordingly, an object of this invention is to provide a new and improved shower closure.

Another object of this invention is to provide a new and improved shower closure which is aesthetically appealing and easily installed and removed.

A further object of this invention is to provide a new and improved shower closure which prevents water from spilling outside the shower but is low cost compared to the prior art.

A more specific object of this invention is to provide a new and improved shower closure by providing unique locking channels at the shower walls to which the shower curtain is securely fastened to prevent water from spilling outwardly.

SUMMARY OF THE INVENTION

This invention relates to closures for showers and bathtubs and in particular, shower curtains. In accordance with the present invention, a system is provided for converting a bathtub area into an enclosed substantially waterproof shower enclosure by means of adding or modifying the shower curtain installation by providing inner closure channels at each end of the shower curtain as well as corresponding outer retention channels that are easily fixed onto opposed walls in the bathtub enclosure for sealingly receiving the side edges of the curtain in a waterproof relationship. Each end of the shower curtain is retained within a vertically disposed U-shaped inner channel having longitudinal ridges within the U-shaped channel for retention of a flexible slit grommet spline or locking rod running lengthwise. The edge of the shower curtain is inserted into the flexible spline or locking rod or wrapped around it and then pressed fit into the inner U-shaped channel. The curtain is securely retained by friction between the spline and the internal longitudinal ridges and walls of the U-shaped inner channel which is secured to the outer retention channel in similar fashion.

The outer frame comprises two spaced apart U-shaped outer channels slightly larger than the inner channels in which the curtain is rolled and which are adhesively retained in a water tight sealing engagement with the primary frame piece of the bath or shower stall.

The outer channels are secured to the installation walls with means such as double stick tape or caulking or threaded fasteners such as Phillips head screws passing through the base of the U of each channel with the open edge of the U facing outwardly towards the shower curtain.

The inner channel is provided with a ridged longitudinal handle integrally formed therewith for moving the shower curtain in and out of the outer channel. In effect, one has erected a portable shower enclosure with an easily closable sliding door. Since the inner channels can both open and close the curtain, the user may enter or exit from either end. If desirable, weights may be placed on the lower edge of the curtain to help retain it snugly against the base of the enclosure to further prevent water from reaching the external floor of the room.

Such an improvement greatly increases the utility of an ordinary bathroom and prevents water damage. In addition to keeping the water inside, it serves as a convenient means of excluding pets from the shower area.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
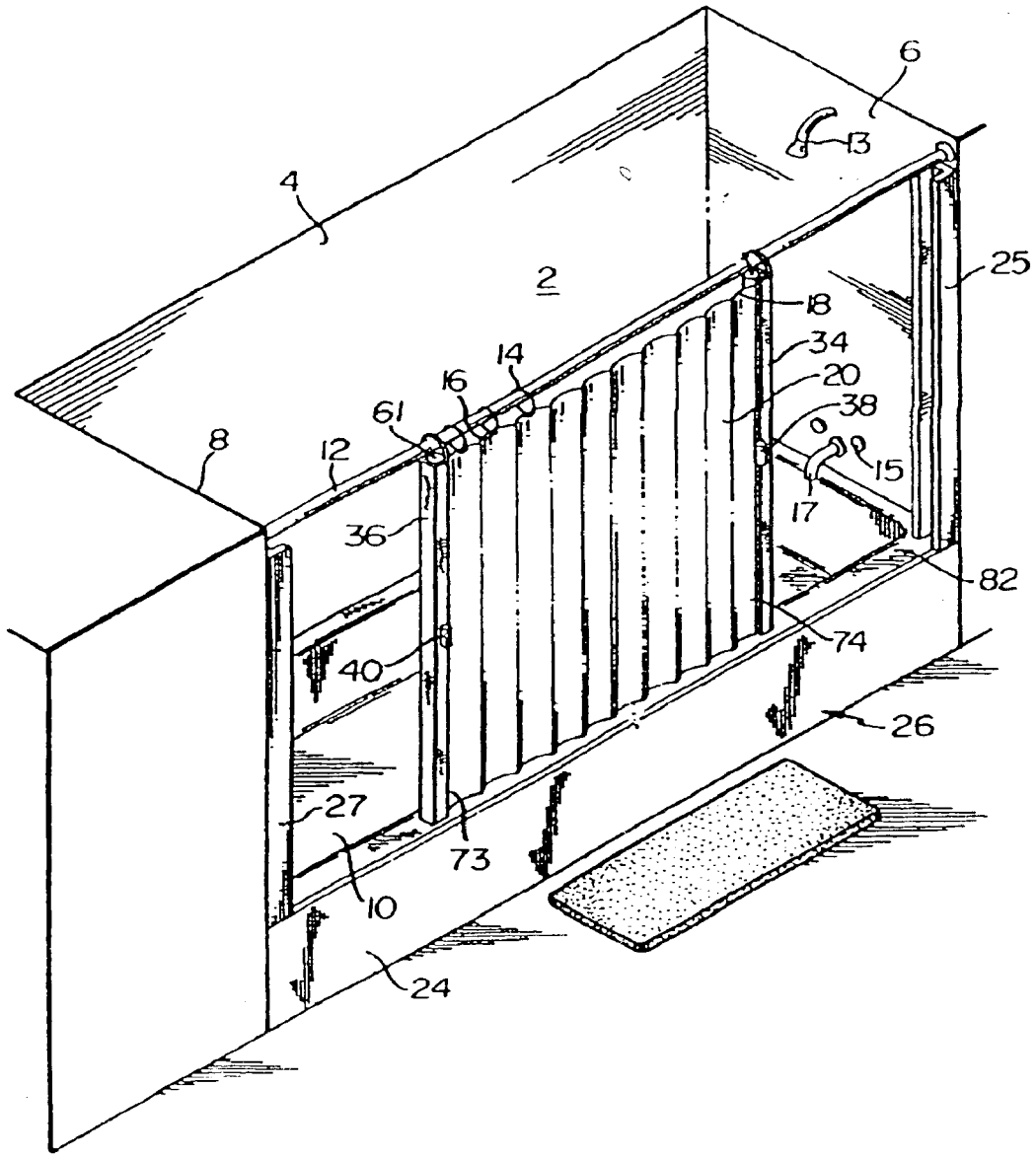
FIG. 1 is a perspective overall view of the device installed in a conventional tub enclosure with a curtain in the open position.

Referring now to the drawings and particularly to FIG. 1, a bathtub enclosure is indicated generally at 2 and includes back wall 4, side walls 6 and 8, an open front 10 spanned by shower curtain rod 12, shower nozzles 13, faucets 15, spigot 17 and the outer bathtub wall 24.

A conventional curtain rod 12 spans the space between the walls 6 and 8 and includes the suspension rings 14 which are fitted into apertures 16 in the top edge 18 of the curtain 20. The curtain 20 is in touching relationship with the top edge 82 of the outer wall 24 of the tub 26 or the inner surface of outer wall 24.

The device 2 of the present invention includes the U-shaped outer vertical channels 25 and 27 on the opposed walls 6 and 8 respectively, secured thereto by screws or conventional adhesive means.

Each vertical edge 73 and 74 of the curtain 20 is secured in a U-shaped inner channel 34 and 36 by one of several means.

Figure 2:
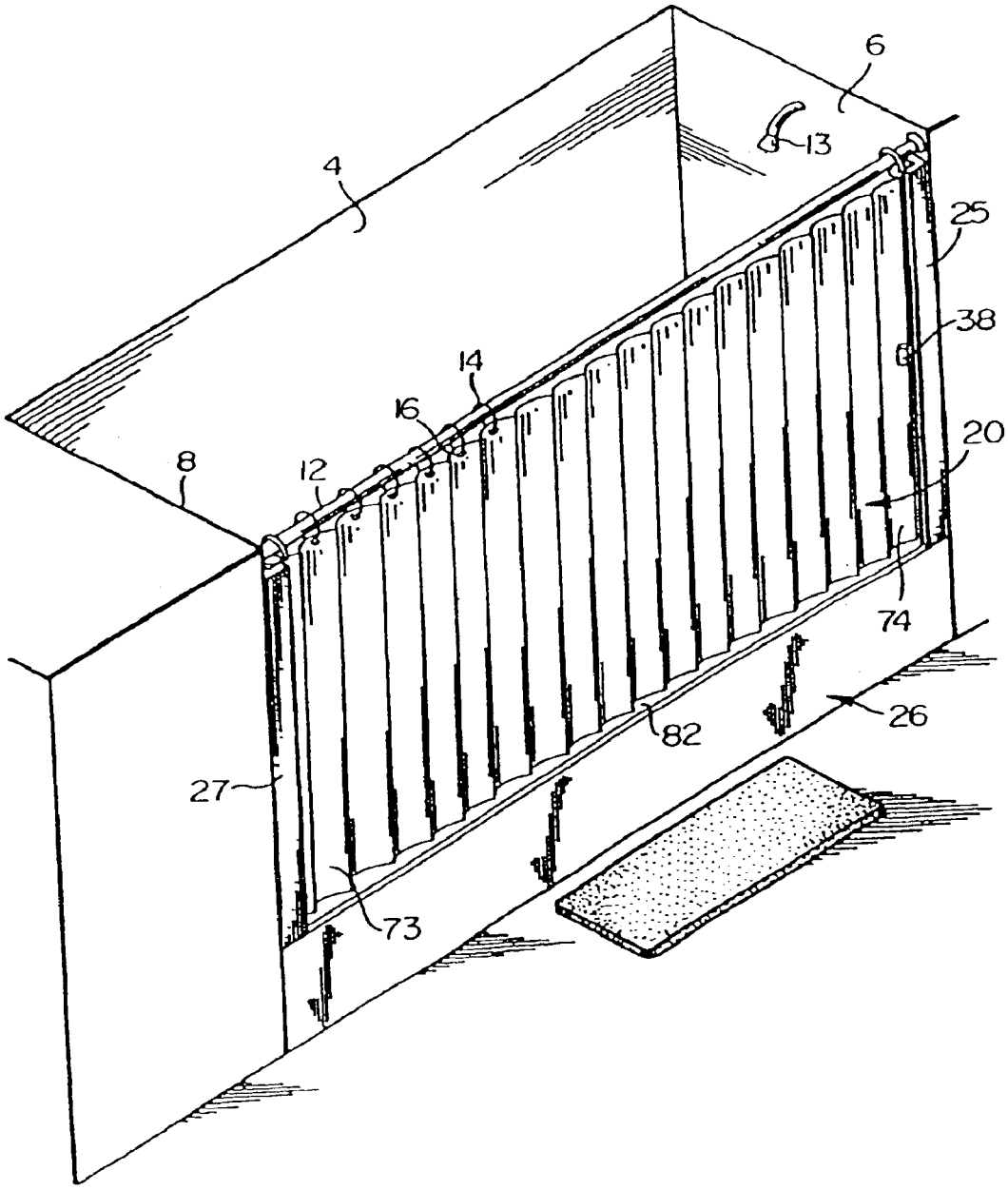
FIG. 2 is a similar view with the curtain in the drawn closed position.
Figure 3:
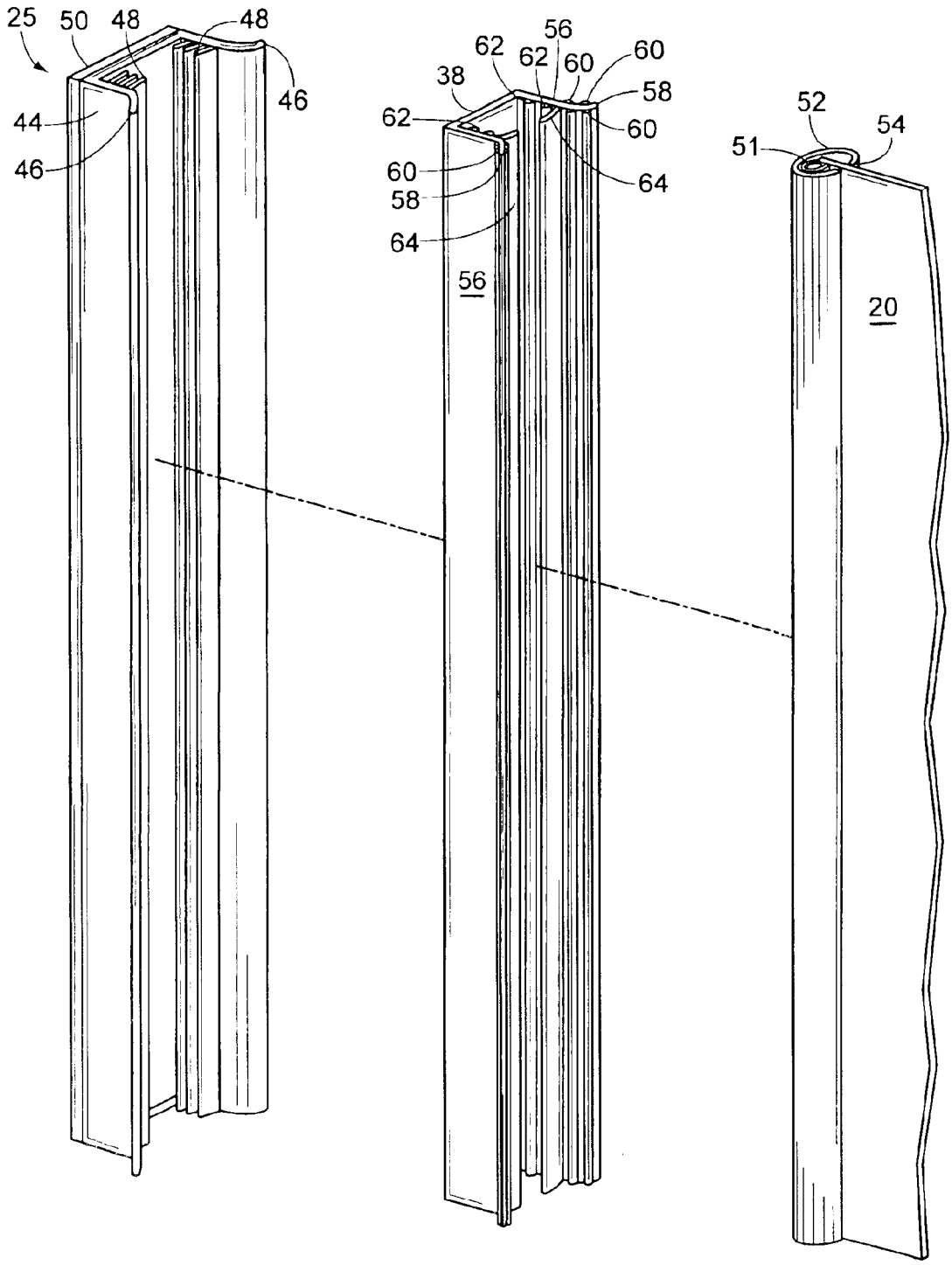
FIG. 3 is a perspective view of the details of the main components of the system and the relationship to each other including the frame for the enclosure and the portion grasping the shower curtain.

The curtain 20 is shown drawn closed in FIG. 2 with the U-shaped inner channels 34 and 36 at each vertical edge 73 and 74 of the curtain 20 snugly fitting into with the matched U-shaped outer channels 25 and 27 that are vertically secured to the opposed enclosure walls 6 and 8.

The curtain 20 is shown hanging in tangential relationship with the top surface 82 of the tub 26. It is preferred that the curtain 20 hang inside the tub 26 with the curtain 20 sufficiently long to be below the top edge 82 of the tub 26.

The channels 25, 27, 34 and 36 may be comprised of extruded aluminum or stainless steel to resist corrosion or extruded rigid PVC acrylic or other plastics and composites which are preferable due to cost effectiveness and color variation. In the damp environment of the bathroom, particularly in connection with the shower. They are resistant to corrosion, will wipe to a lustrous finish and are very easily cleaned.

The improvements to the shower curtain closure will become evident when considering FIGS. 3, 4, 5, and 6 which are perspective and profile views of the improved U-shaped outer channels 25 and 27 as mounted on the enclosure walls, the improve U-shaped inner channels 38 and 40, and the improved locking rod 52 for cooperation with the shower curtain 20 and the improved inner channels 38 and 40 respectively.

Figure 4:
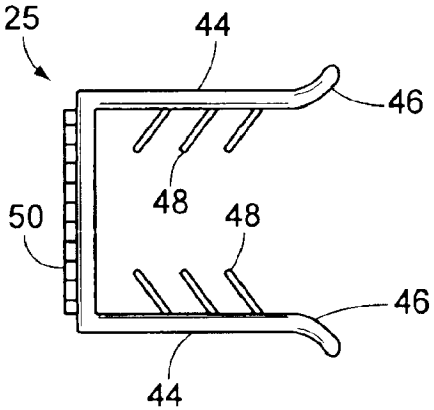
FIG. 4 is a profile view of the improved U-shaped outer channel as mounted on the enclosure walls.

The improved outer channels 25 and 27 have side walls 44 that are flared outwardly at their front edges 46 in order to more readily accept the improved inner channels 38 and 40. Further, the improved outer channel side walls 44 are formed with a plurality of flexible inwardly depending fingers 48 which form a seal with the improved inner channels 38 and 40 and greatly reduces moisture penetration into the improved outer channels 25 and 27 from the shower. The improved outer channels 25 and 27 are secured to the walls 6 and 8 of the shower 2 by any suitable means and as illustrated in FIG. 4, a double sided tape 50 of adhesive material is utilized.

Figure 6:
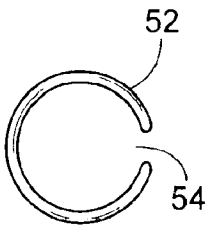
FIG. 6 is a profile of an improved locking rod for cooperation with the shower curtain and improved handle channel.

FIG. 6 consists of a profile view of an improved locking rod 52 of the present invention with a slit 54 for receipt of the vertical edge 73 or 74 of shower curtain 20. This vertical edge 73 or 74 of the shower curtain 20 is inserted into the slit 54 lengthwise throughout the vertical length of the locking rod 52, or alternatively wrapped around the outer side of the locking rod 52. If the vertical edge of shower curtain 20 is inserted into locking rod 52, it is preferably overlapped and seamed to enclose a stiffening material to maintain its position within locking rod 52. The slit 54 also serves to relieve pressure on the locking rod while it is being press fit into the improved inner channels as described hereafter.

Figure 5:
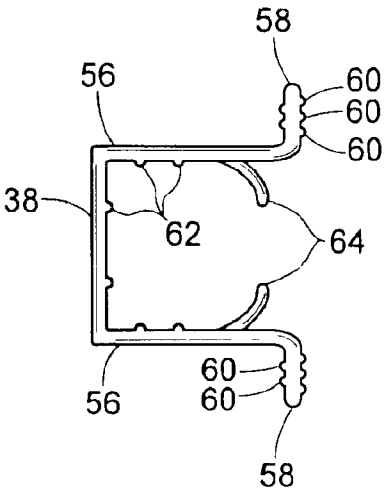
FIG. 5 is a profile view of the improved U-shaped inner channel and the portion which enclosed the edges of the curtain.

FIG. 5 consists of a profile of the improved inner channels 38 and 40, the side walls 56 of which are formed with flared handles 58 which handles 58 extend the length of the improved inner channel side walls 56 and are formed with built in ridges 60 to improve grip. Inside the side walls 56 there is formed ridges 62 which accept frictional engagement of the locking rod 52 and shower curtain. Bordering the opening of the improved inner channel are inwardly depending flexible fingers 64 forming a seal which are cooperative with those fingers 48 found in the improved outer channel 25 side walls 44 to reduce moisture penetration into the channel.

Figure 7:
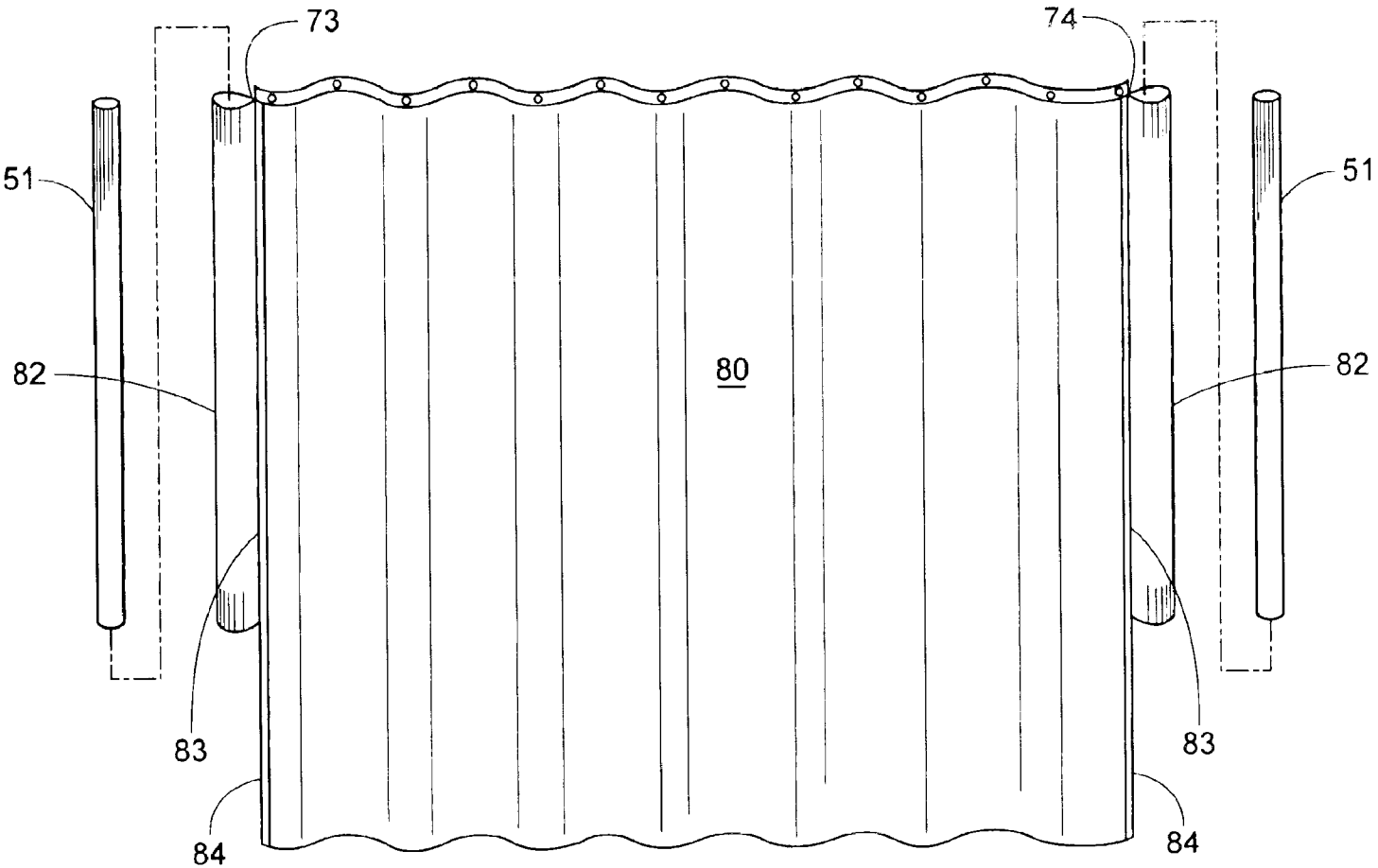
FIG. 7 is a planar front view of a shower curtain specifically designed for Applicant's shower closure.

In the configuration thus described, the improved shower curtain closure can be utilized with a standard shower curtain to form the closure. However, the closure means can be made even more secure with the use of an improved shower curtain 80 illustrated in FIG. 7. Improved shower curtain 80 is formed with a sleeve member 82 at its vertical edges 73 and 74 defined by seam 83. Sleeve members 82 are open at the top or the bottom for the receipt of a locking rod 52 as heretofore discussed. The locking rod 52 would extend for the entire length of the sleeve 82. The lower edge 84 of the shower curtain would extend beyond the sleeve members 82 so as to drape inside the bathtub when the locking rod and inner channel assembly are engaged to the curtain sleeves 82. Locking rod 52 and sleeve members 82 world then be press fit into channels 36 and 38. Alternatively, a stiffening material 51 could be sewn or positioned in sleeve member 82 to press fit into channels 36 and 38.

If the channels 36 and 38 and locking rod 52 are fabricated from PVC or other suitable polymers, their weight would be such that suspension rings 14 which support the shower curtain would be sufficient to support the channels 36, 38, and locking rods 52. If additional support was required, channels 36 and 38 could be formed with apertures for cooperation with a suspension ring as taught in Applicant's prior U.S. Pat. No. 6,148,452. Additional means of supporting the channels 36, 38, and locking rods 52 could include a press fit threaded insert into the upper end of the channels 36 and 38 and in particular, the upper end of locking rod 52, the press fit insert having a hook or other suitable attachment means formed thereon for cooperation with the curtain rod 12.

While the present invention has been described with respect to the preferred embodiments thereof, it will be recognized by those of ordinary skill in the arts that many modifications can be made without departing from the scope and spirit of the invention. In particular, the basic embodiment of Applicant's invention comprises a elongate longitudinal female channel secured to opposing end walls of a bath enclosure. These female channels are cooperative with elongate, longitudinal, vertically disposed male channels having the vertical edges of a shower curtain removably secured thereto such that the male channels are cooperative with and press fit into the female channels to form a barrier across the tub enclosure and prevent the egress of water from the tub enclosure to the bathroom floor. The preferred embodiments of the manner in which the shower curtain is secured to these male channels is disclosed herein, however, there are alternative means of securing the shower curtain to the male channels without departing from the spirit and scope of the invention.

The improved shower curtain design offers an aesthetic and functional alternative to the use of a standard shower curtain, although a standard shower curtain will work with the system. The improved shower curtains recessed vertical edges prevent bunching or gathering of the curtain at the top of the curtain rod as well as the edge of the bathtub while creating a more efficient water seal along the bathtub due to the flatter water shed surface. The sleeves allow the shower curtain to be easily engaged in the inner channel by inserting a stiffening material into the sleeve and threading into the notch of the locking rod. As an alternative, the entire locking rod could be placed inside the sleeve and then press fit into the inner channel.

The improved locking rod is notched along its vertical length to allow insertion of the curtain vertical edge. The notch portion also relieves stress on the sides of the locking rod while it is being inserted by press fit into the improved inner channel. The improved locking rod is functional for both the improved shower curtain as well as a standard shower curtain depending upon the needs of the consumer. The improved locking rod can be made from a wide variety of rigid, semi-rigid or flexible materials and in shapes other than that of a circular cross section, as long as it performs the identical function.

The improved inner channel now has fully integrated full length handle with finger grips. This allows the piece to be extruded, molded or otherwise manufactured in a single step. It reduces the amount of secondary parts and eliminates the need for threaded fasteners. The integrated handle allows for easy access from inside or outside the shower regardless of the user's height, and without having to measure each system individually in order to mount a separate handle. The integrated full length handle with finger grips also allows for the manufacturing process to allow finishes to be applied to the handle channel. The two inwardly depending fingers which provide for a seal in the inner channel serve to maintain the curtain centered in the inner channel and also serve to seal and deflect water and prevent it from entering the inner channel. The locking ridges inside the inner channel help secure the locking rod.

The improved outer channel is formed with integrated water tight seals. These inwardly depending fingers 48 which form the seals are flexible and reduce the chance of water penetrating the outer channel. There being three sets of inwardly depending fingers forming these seals on each side wall of the outer channel allows the user to close the curtain by press fitting the inner channel at various degrees of tension, from light to full by engaging the first, second or third set of inwardly depending fingers 48. The inwardly depending fingers 48 forming the seals eliminate the need for a magnet, Velcro or other means, keeping the inner channel and the outer channel in a secure closed position.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. Shower enclosure for bathtubs having a rear wall, side walls, and a partial front wall, the enclosure comprising:

retention channels mounted on each side wall comprising a first U-shaped channel having a base and outwardly extending legs, said outwardly extending legs having formed thereon, vertically oriented elongated ridges, said outwardly extending legs being flared at their ends;

a shower curtain rod extending between and above said retention channels;

a shower curtain mounted on said shower curtain rod and extending downwardly to engage the partial front wall of said tub, said shower curtain having opposing vertical edges;

a second vertical, U-shaped channel having a base and outwardly extending legs mounted to each vertical edge of said shower curtain, said vertical U-shaped channel having vertically oriented ridges on said legs, said legs being flared at their ends and having vertically oriented ridges positioned on said flared ends to serve as a handle means;

a hollow locking rod having an elongated longitudinal slit along its vertical length, said locking rod cooperative with said vertical edge of said shower curtain, said locking rod and said vertical engaged edge of said shower curtain being press fit into said second vertical U-shaped channel;

a securing means for securing said retention channel to said side walls of said tub whereby said second vertical U-shaped channel having said vertical edge of shower curtain secured therein, is removably engageable in said first U-shaped channel secured to said side walls of said tub for providing an enclosure for said tub.

2. The shower enclosure in accordance with claim 1 wherein the base of said retention channeling includes fastening means to mount said channel on said side wall of said bathtub.

3. The shower enclosure in accordance with claim 2 wherein said fastening means comprises double stick tape.

4. The shower enclosure for bathtubs in accordance with claim 1 wherein said shower curtain is wrapped about said hollow locking rod and press fit into said second vertical U-shaped channel.

5. The shower enclosure for bathtubs in accordance with claim 1 wherein said shower curtain is formed with a hem, encapsulating a stiffening material along said opposing vertical edges.

6. The shower enclosure for bathtubs in accordance with claim 5 wherein said stiffening material encapsulated in said opposing vertical edges of said shower curtain is slidably received within said hollow locking rod via said elongated longitudinal slit along said locking rod's vertical length.

7. A shower enclosure for bathtubs in accordance with claim 1 wherein said shower curtain is formed with sleeve members along said opposing vertical edges, said sleeve members open at said top or said bottom.

8. A shower enclosure for bathtubs in accordance with claim 7 wherein said sleeve members along said opposing vertical edges of said shower curtain slidably receive said hollow locking rod for press fit engagement into said second vertical U-shaped channel.

9. A shower enclosure for bathtubs in accordance with claim 1 wherein said second vertical U-shaped channel and said hollow locking rod are supported by said shower curtain mounted on said shower curtain rod.

10. A shower enclosure for bathtubs in accordance with claim 1 wherein said second vertical U-shaped channel and said hollow locking rod are directly supported from said shower curtain rod.

* * * * *